US008716587B2

(12) United States Patent
Degerland

(10) Patent No.: US 8,716,587 B2
(45) Date of Patent: May 6, 2014

(54) MUSICAL INSTRUMENTS

(76) Inventor: Eric John Degerland, Mayfield East Sussex (GB)

( * ) Notice: Subject to any disclaimer, the term of this patent is extended or adjusted under 35 U.S.C. 154(b) by 0 days.

(21) Appl. No.: 13/386,370

(22) PCT Filed: Jul. 20, 2010

(86) PCT No.: PCT/GB2010/051180
§ 371 (c)(1),
(2), (4) Date: Feb. 16, 2012

(87) PCT Pub. No.: WO2011/010134
PCT Pub. Date: Jan. 27, 2011

(65) Prior Publication Data

US 2012/0137859 A1 Jun. 7, 2012

(30) Foreign Application Priority Data

Jul. 22, 2009 (GB) ..... 0912663.2

(51) Int. Cl.
*G10H 1/32* (2006.01)

(52) U.S. Cl.
USPC ..... 84/743

(58) Field of Classification Search
USPC ..... 84/743
See application file for complete search history.

(56) References Cited

U.S. PATENT DOCUMENTS

| | | | | |
|---|---|---|---|---|
| 2,204,028 | A * | 6/1940 | Richeda | 84/376 A |
| 5,929,362 | A * | 7/1999 | Oteyza | 84/743 |
| 6,946,594 | B2 * | 9/2005 | Bruti et al. | 84/604 |
| 2004/0244566 | A1 | 12/2004 | Steiger | |
| 2005/0109196 | A1 | 5/2005 | Whiteside | |
| 2008/0236374 | A1 * | 10/2008 | Kramer et al. | 84/733 |
| 2009/0042650 | A1 * | 2/2009 | Chiwata | 463/37 |
| 2009/0191966 | A1 | 7/2009 | Ross | |

FOREIGN PATENT DOCUMENTS

| | | | |
|---|---|---|---|
| WO | 2004008430 | A1 | 1/2004 |
| WO | 2008154510 | A2 | 12/2008 |
| WO | 2011010134 | A4 | 1/2011 |

* cited by examiner

*Primary Examiner* — Jianchun Qin
(74) *Attorney, Agent, or Firm* — Dicke, Billig & Czaja, PLLC

(57) ABSTRACT

Musical instruments are described including a first portion designed to be operated by one hand of a player and a second portion designed to be operated by the other hand. The two portions include means within each for sensing hand and/or finger activity, position or movement, and one of the portions is adapted to produce an output signal corresponding to the music being played by the user. The two portions may be physically connected together or they may be separate, each including its own power supply to enable it to operate, and for the two portions to communicate with one another. The invention is of particular value in the construction of practice instruments which do not need to include a sound box, and can thus be very compact, especially if the two parts, such as a fingerboard (20) and a body (82) with strings (83) mounted on it are connected by a telescopic neck (60A).

8 Claims, 17 Drawing Sheets

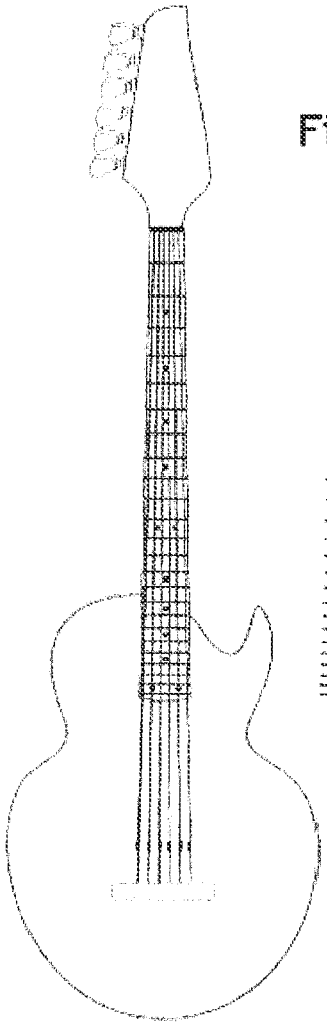
Figure 4B
Fig.5E
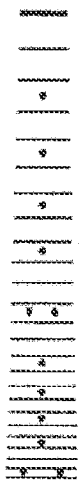
Fig.5F
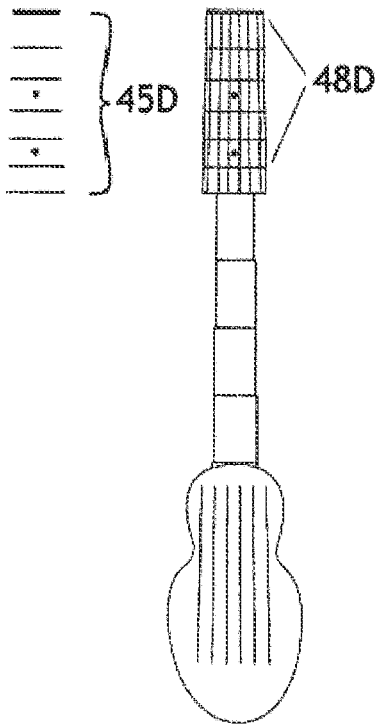
Figure 6E

Fig. 5G
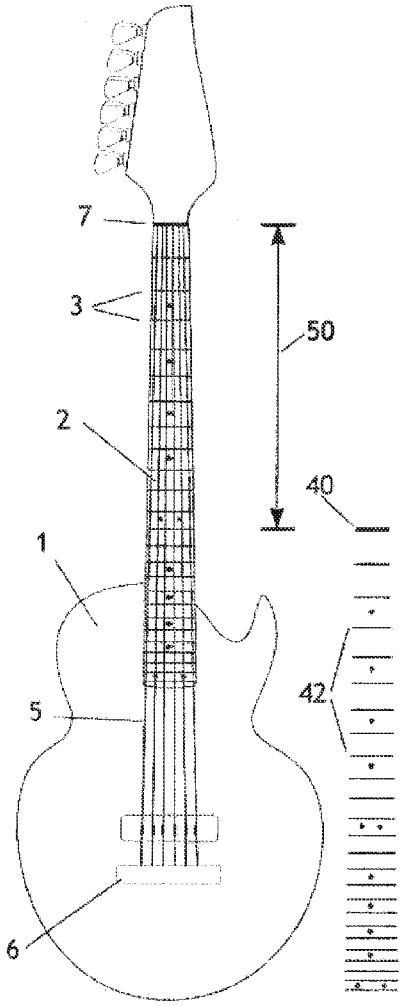
Fig. 5H
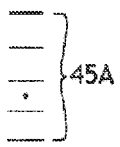
Fig. 5I
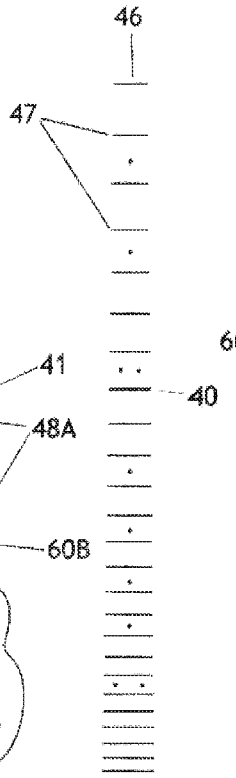
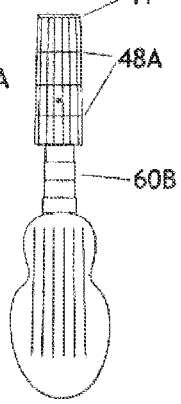
Figure 7
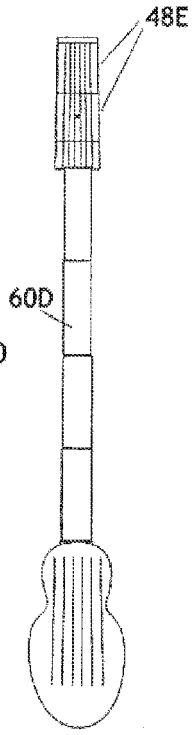
Figure 8

41
48A
20
43
44
41
60A
82
43
44

| S0 | S1 | |
|---|---|---|
| L | L | Hold |
| L | H | Shift Left |
| H | L | Shift Right |
| H | H | Parallel Load |

MUSICAL INSTRUMENTS

RELATED APPLICATIONS

This application is a 371 National Stage entry of PCT/GB2010/051180, filed on Jul. 20, 2010, which in turn claims priority of United Kingdom application GB 0912663.2 filed on Jul. 22, 2009.

This invention relates to musical instruments and, in particular, to instruments which are played by using the hands in different fashions, for example using one hand to select pitch and the other to condition the timing and nature of the sound produced. The invention is of particular application to plucked stringed instruments such as guitars, ukuleles, mandolins and the like, but is not restricted in its application to such instruments.

In another aspect, the present invention relates to practice instruments which may replicate parts of the corresponding 'real' instrument, but which may not be designed for performance, such practice instruments, in accordance with the teachings of the present invention, may be used unobtrusively by a player, for example when on public transport.

In accordance with a first aspect of the invention, there is provided a musical instrument having a first portion designed to be operated by one hand of a player and a second portion designed to be operated by the other hand, means within each of the two portions for sensing hand and/or finger activity, position or movement, means in one of the portions adapted to produce an output signal corresponding to the music being played by the user, and wherein the two portions may or may not communicate wirelessly with one another. The sensing means may be selected from a variety of possible sensors: proximity sensors, piezo-electric transducers, pressure sensors, and other sensors operating on the basis of capacitative, inductive or resistive change.

The two portions may be physically connected together or they may be separate, each including its own power supply to enable it to operate. The wireless communication may be by means of any convenient transmission system using e.g. infrared or microwave transmission. The Bluetooth system may be used if desired.

In accordance with a further aspect of the invention, there is provided a musical instrument including two separate interacting units, each of which may be played using the fingers of one hand, and one of which includes means for generating an output signal corresponding to the music generated by the user when playing the instrument, and wherein means are provided to detect the degree of separation of the units from one another and to modify the output signal in response thereto.

Constructing a musical instrument in this way enables the music it produces to be varied by varying the configuration of the instrument itself. A convenient approach is to telescope the units together so that they may be played with the hands relatively close to one another or at a distance apart, and where the degree of telescoping is arranged to change the way in which the input to the instrument from at least one of the player's hands is treated.

While it is generally convenient to link the two interacting units of such a musical instrument mechanically, this is not necessary if each contains its own power supply and they are provided with means to communicate with one another over a short distance, for example using infrared transmission technology in accordance with the so-called Bluetooth protocol.

In accordance with a specific feature of the present invention, there is provided a musical instrument consisting of a finger board portion and a body portion provided with a plurality of real or virtual strings which may be 'plucked' by the user, and wherein finger board portion and body portion are connected together so that actuation of one or more of the strings by one hand will cause a signal to be emitted corresponding to one or more musical notes, the pitch of which is determined by the position of the fingers of the other hand on the finger board portion.

The finger board portion may be configured to look like a short section of a corresponding conventional instrument, corresponding in length to the maximum span of the player's fingers, e.g. the length spanned by the first four or five frets on a guitar adjacent the nut. The body portion may be much smaller than its counterpart in a conventional instrument, as it does not have to include a sound box. It may be held in place, e.g. against a player's body, by the player usually with a suitable strap to maintain it at the right length when the player's hand is removed.

Preferably both finger board and body portions have real strings to simulate the feel of a conventionally plucked stringed instrument such as a guitar, but it is not necessary that there are any 'strings' at all. However, provision of strings on the body portion maintains the player's calluses, as well as providing a mechanism whereby the volume of sound produced may be varied, as would be the case for a real guitar, by varying the degree to which the string is stretched prior to release.

Additionally, if the strings are made from a nickel-titanium alloy of the 'Muscle Wire' category, for example 'Flexinol'®, the change in tension of the strings of a standard stringed instrument over their length can be emulated by the passing of a small current through the strings.

Preferably the finger board portion is provided with an indicator means which may be arranged to simulate the frets of a guitar and, if desired, the customary fret markers or inlays. Additionally or alternatively, the indicator means may indicate pitch directly, for example using musical or other symbolic notation.

In a particularly preferred embodiment, the finger board portion, or 'fingerpad', and the body portion are connected together by means of a telescopic neck which may be extended or collapsed and where the degree of extension is arranged to modify the pitch of the notes produced. By operating in this way, it is possible to make a guitar type musical instrument which may be very conveniently folded up, particularly if the telescoping section includes some form of hinge or swivel means enabling the fingerpad to be folded down to face the body portion. When being played, moving the fingerpad portion towards the body portion will cause the display on the fingerpad position to change so that it corresponds with the image of a part of the finger board on a conventional instrument further from the nut.

The instrument may be arranged to provide an appropriate audio signal output which may be, for example, fed to a pair of headphones or earplug type audio transducers to enable the person playing the instrument to hear it, or which may feed an appropriate amplification system with the music played on the instrument then being emitted from loudspeakers. Alternatively, the output may be converted to a storable format, e.g. MIDI, MP3 or OSC, or to a format which may be shared with other users, either located nearby or remotely—e.g. via the Internet. The conversion of sensed finger or hand movements or positions into audible output is carried out in instruments according to the invention, by one or more microprocessor-based units located in one or both parts of the instrument.

By suitable programming, musical instruments in accordance with the present invention may be rendered highly versatile. For example, the tuning of the notes to be played may be set up in accordance with one of a number of alternatives, for example selected from an appropriate menu, and the instrument accordingly modified to emulate a particular instrument of choice, or to create a wholly new type of instrument. The programming may be achieved using the fingerpad by means of an appropriate display in the fingerpad and sensors associated therewith. Those sensors, when the instrument is being played, detect finger position and, for example, the degree of pressure applied, but, in a programming mode, may be used as a screen to interact with the user. An appropriate graphical user interface may easily be built into the microprocessor which is employed in the core of instruments in accordance with the present invention.

Suitable programming of the microprocessor(s) may enable a range of possibilities to be explored, for example

- Any scale length or pitch range may be chosen
- The pitch may be varied continuously or stepwise, corresponding to a fret-less or fretted finger board
- The number of 'strings' may be varied (with corresponding hardware variation if desired), for example replaceable 4- or 6-string attachments for tactile authenticity of the fingerpad and body portions of a plucked string instrument
- The instrument may be easily converted from right to left-handed stringing or vice versa
- Equal Temperament or Just Intonation tuning may be selected
- 12-tone Chromatic, 5-tone Pentatonic or any other scale may be selected
- The voice of the instrument may be selected, for example, from bass guitar to ukulele for plucked stringed instruments, or from other instruments such as wind instruments where the fingerpad may correspond to the keys and holes used by one hand and the body portion to those used by the other.

● The fingerpad may be programmed to provide an output signal even in the absence of corresponding manipulation of the body portion.

In the following description, a musical instrument in accordance with the invention, together with various components thereof is described, where the closest similar conventional musical instrument is an acoustic guitar. However, it will be apparent to those who read this description that the various principles and techniques disclosed therein may be applied in a wide variety of other instruments.

The specific description of the present invention applied to a guitar is as follows: the fingerpad corresponds to part of the finger board, the body portion to the part of the sound board near the bridge, and the telescopic neck to the neck. The micro-processor(s) in fingerpad and/or body portion process inputs depending on the position of the player's fingers on the fingerpad portion, the action of the player's fingers on the body portion, and the degree of separation between them, to produce an audio output dependent on all three inputs.

In greater detail, the localisation of the points of contact between the player's finger(s) and the fingerpad is fed to a main microprocessor continuously, while another input to the main microprocessor is derived from a sensor that detects the degree of extension or retraction of the neck. To achieve additional functionality in musical instruments according to the invention, this is typically an absolute value corresponding to the degree of separation of the fingerpad from the body position though a relative measure of the degree of separation is easily achieved.

From these inputs, the microprocessor calculates the precise corresponding locations of the user's fingers on the equivalent keyboard of an acoustic guitar, and thus calculation of equivalent finger location is then coordinated with the input from the detection of which strings the user is playing with their plucking hand on the body of the instrument to generate a corresponding appropriate output waveform, which may be fed to sound-generation, storage or output circuitry.

As noted above, the fingerpad preferably includes means to provide a visual display of 'virtual' frets (and if desired fret markers) on its surface, to enable the player to see where they should place their fingers, for example by configuring the surface of the fingerpad as a membrane that has multiple light-emitting bars. The light-emitting bars may be made from, for example, light-emitting diodes (LEDs), organic light-emitting diodes (OLEDs) or electroluminescent display means.

Each light-emitting bar is preferably of the order of 1 mm wide and spans the width of the fingerpad's surface in one or more segments. The pitch between adjacent bars is conveniently the same as the resolution of the sensor that detects the degree of extension of the neck, e.g. about 1 mm.

The microprocessor may be programmed to calculate which bars should be illuminated to match the equivalent frets on the finger board of an acoustic guitar for any and all degrees of separation of the fingerpad from the body. Accordingly, as the fingerpad is moved closer to or away from the body, the bars that are to be illuminated will change. Since the scale of an acoustic instrument is not linear, that is, the distance between adjacent frets is different, as the fingerpad moves away from or towards the body, the number of virtual frets illuminated, and the distance between them changes with more bars being illuminated and the distance between each of them being reduced as the fingerpad nears the body.

Likewise the microprocessor may drive illuminatable fret markers positioned appropriately between the illuminated frets.

Microprocessor control enables the user to set the active scale of the instrument as they wish. For convenience, several standard scale lengths are normally preprogrammed including, for example, 864 mm for an electric bass guitar, 635 mm for a 4/4 standard acoustic guitar and, for children, 530 mm for a half-size guitar. However, any scale length can be selected within the physical constraints of the invention. Further, while the scale length may be changed collectively for all 'strings', any single 'string' may have its notes transposed up or down. In addition, the nature of the scale itself may vary: it may be selected from a default setting of twelve-tone equal temperament, where the pitch of the note corresponding to each fret is related to the note corresponding to the adjacent frets by the ratio $\sqrt[12]{2}$. However, since generically the pitch from one fret to the next can be calculated using the ratio $\sqrt[n]{2}$ where 'n' equals the tonal range, by instructing the microprocessor to regard 'n' as, say, '5', a pentatonic scale can be emulated. Other scales can be accommodated by changing the value of 'n'.

A specific embodiment of the invention will now be described, by way of example, with reference to the accompanying drawings.

FIG. 5A shows the spacing of the frets on a conventional guitar, and FIG. 5B how they can be split into three groups for convenience of explanation;

FIGS. 5C to 5I are various diagrams showing the deposition of frets and their arrangements into groups;

Figure 6A:
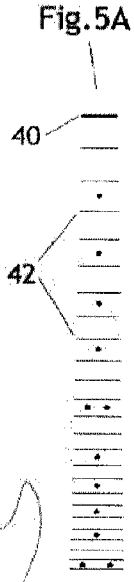
FIG. 6A shows the practice guitar in its fully extended state.
Figure 6A:
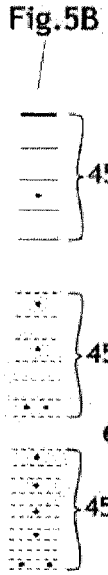
Figure 6A:
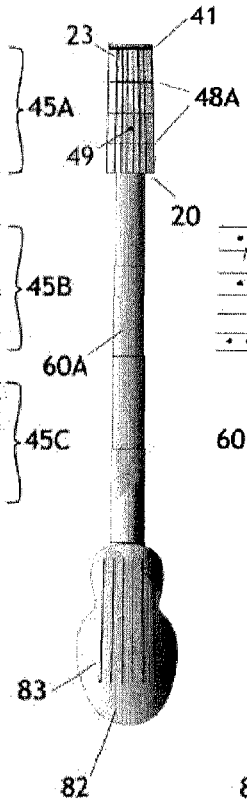
Figure 6B:
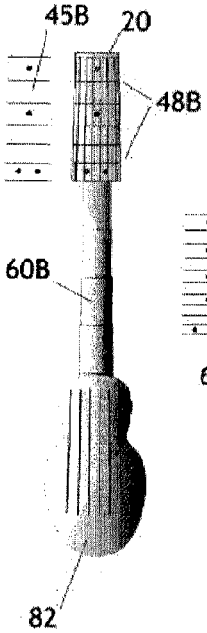
Figure 6C:
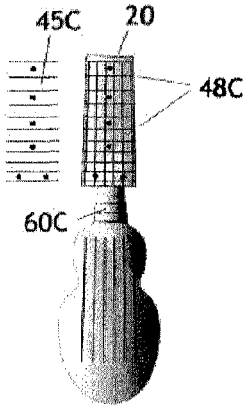
Figure 6D:
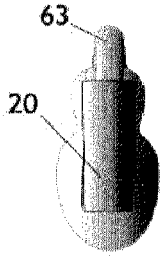

FIG. 6B in a partially extended/retracted state;

FIG. 6C in the fully retracted state;

FIG. 6D its folded state ready for transport or storage; and

Figures 9A, 9B, 10A, 10B, 11A, 11B:
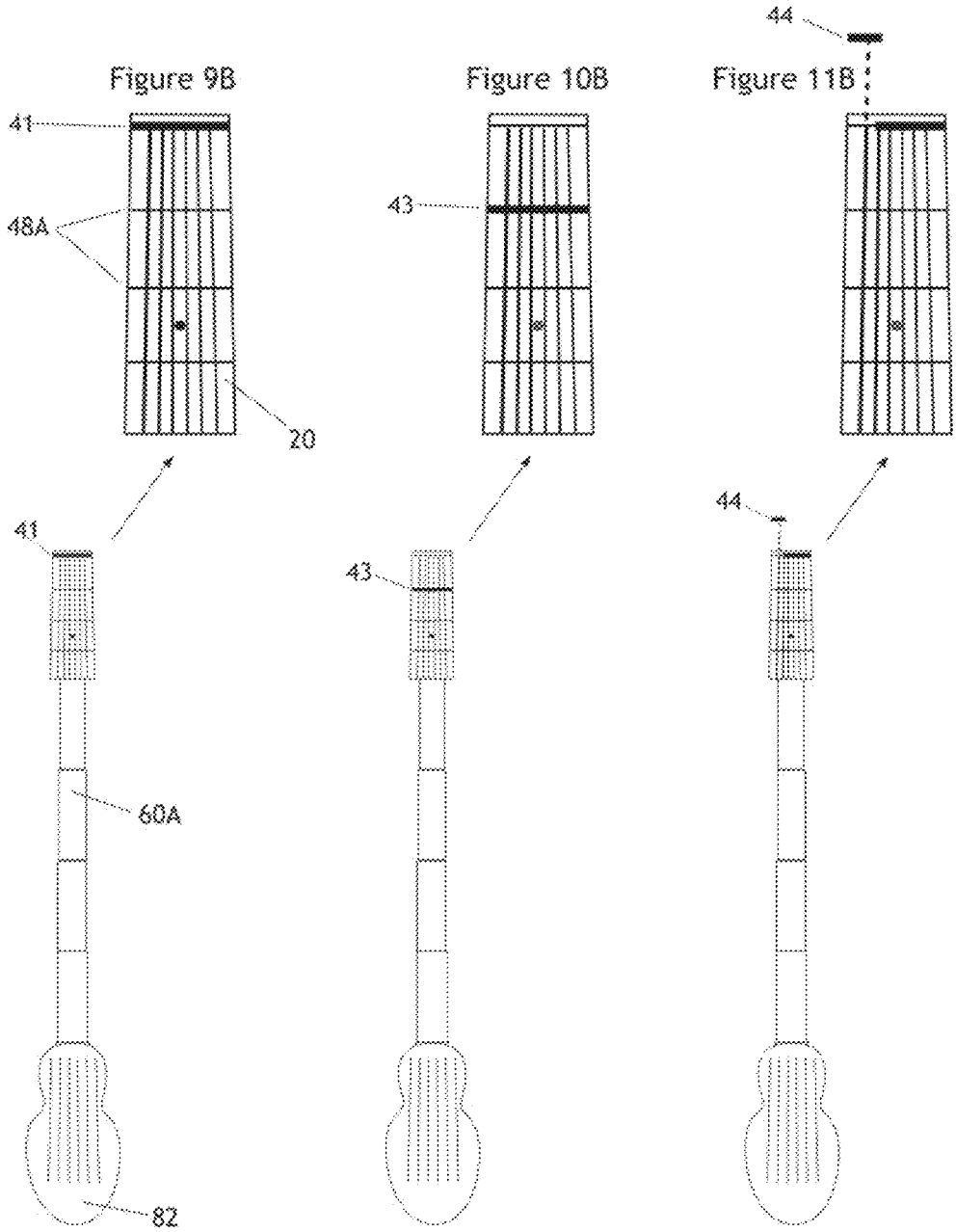
Figure 12A:
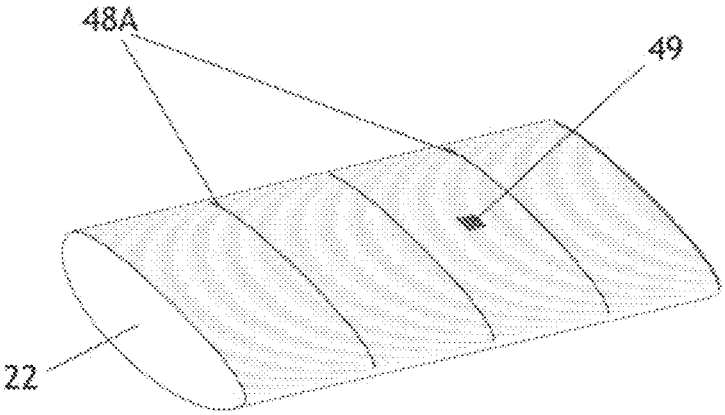
Figure 12B:
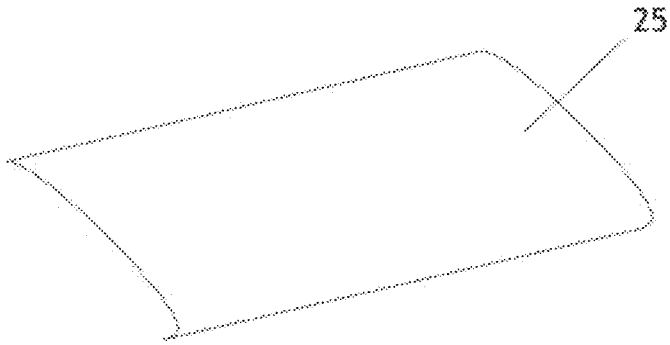
Figure 12C:
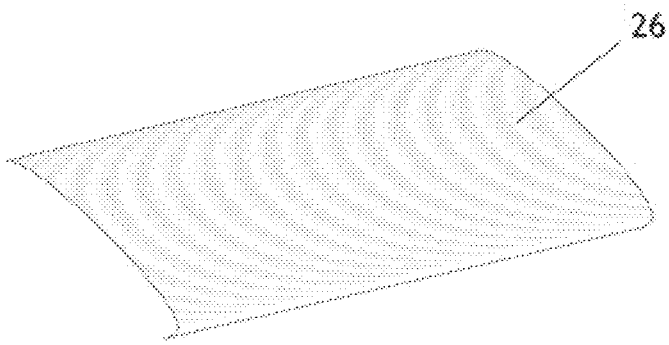
Figure 12D:
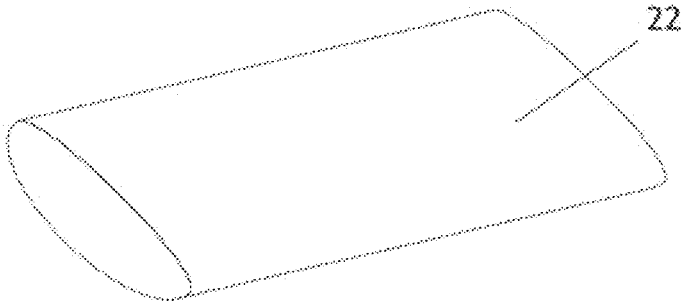
Figure 13A:
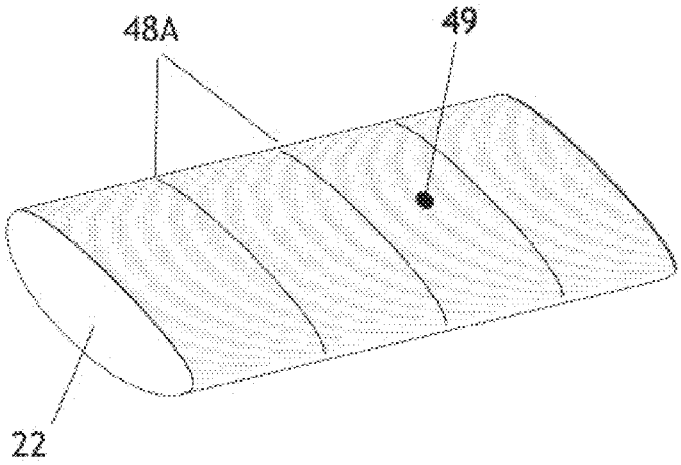
Figure 13B:
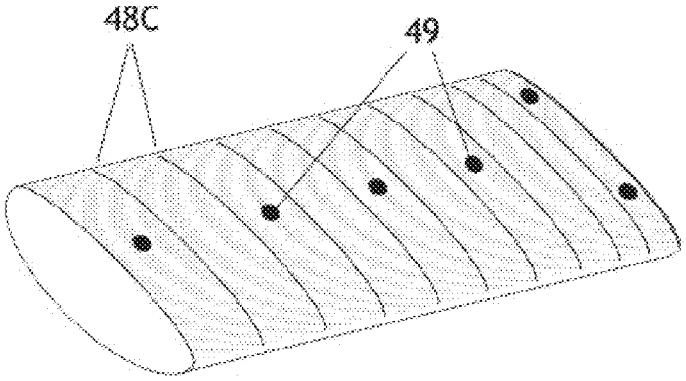
Figure 14A:
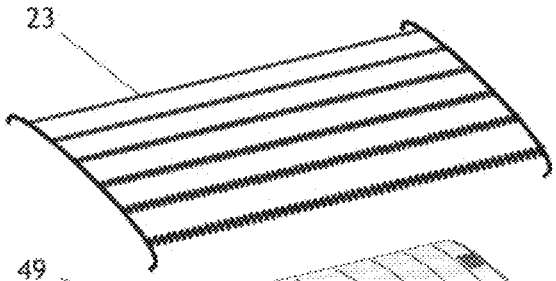
Figure 14B:
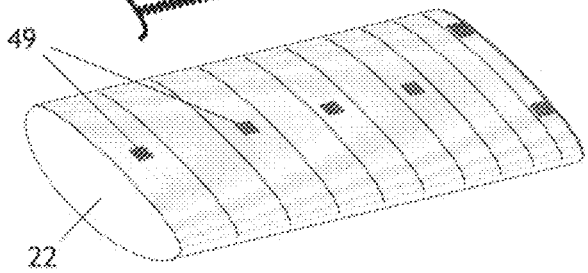
Figure 14C:
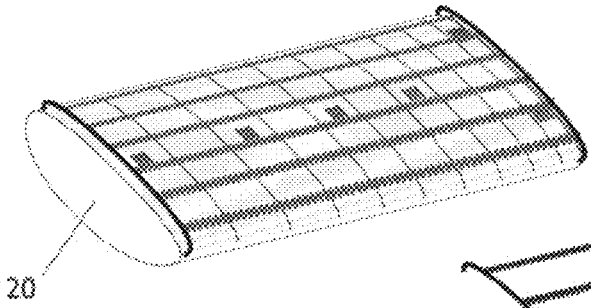
Figure 15A:
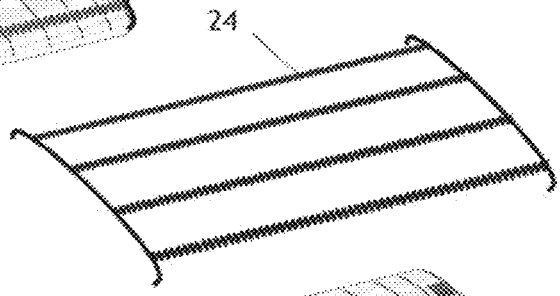
Figure 15B:
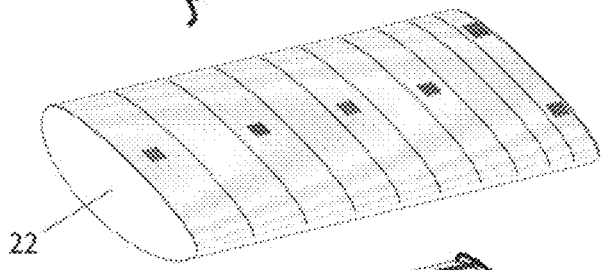
Figure 15C:
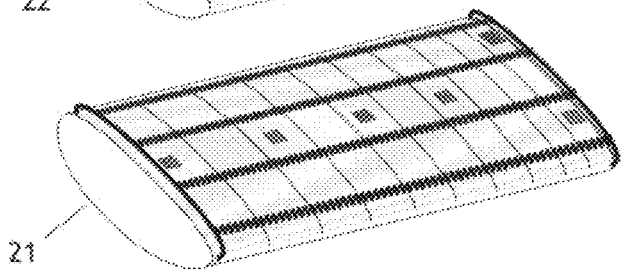
Figure 16A:
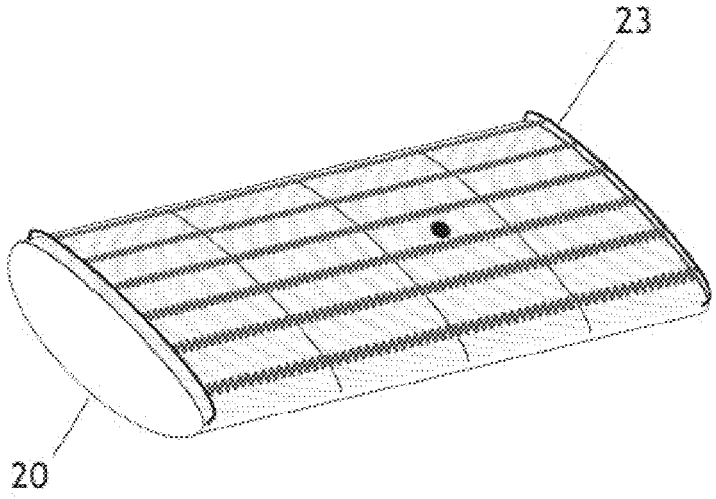
Figure 16B:
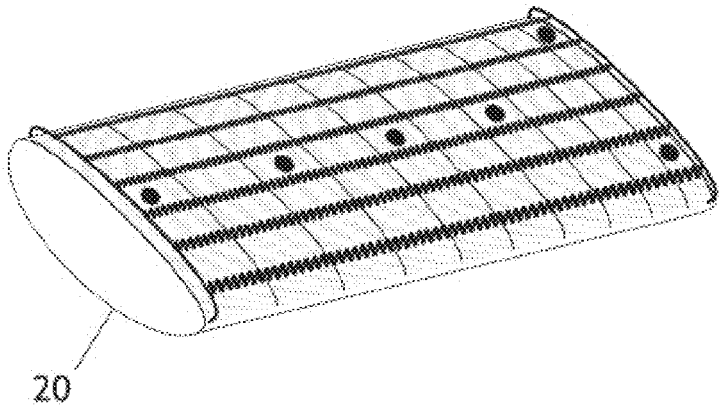
Figure 17A:
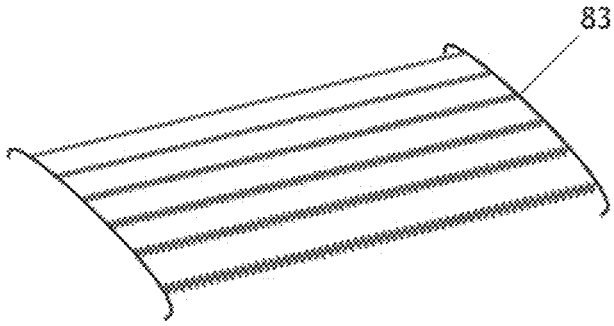
Figure 17B:
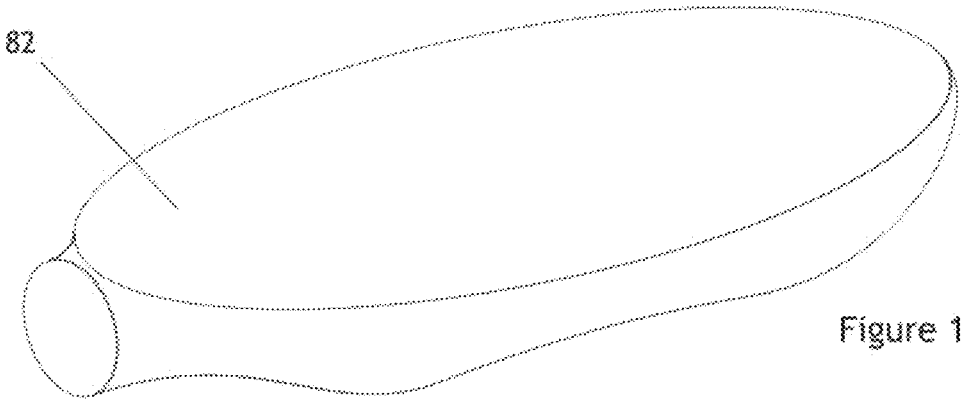
Figure 17C:
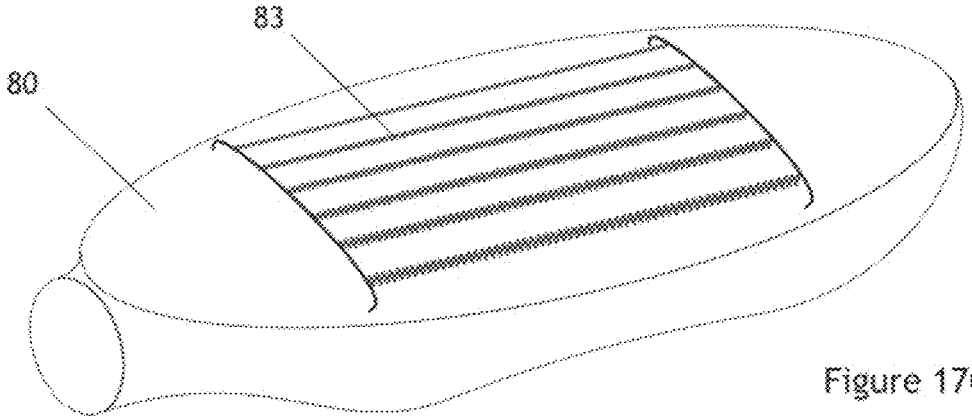
Figure 18A:
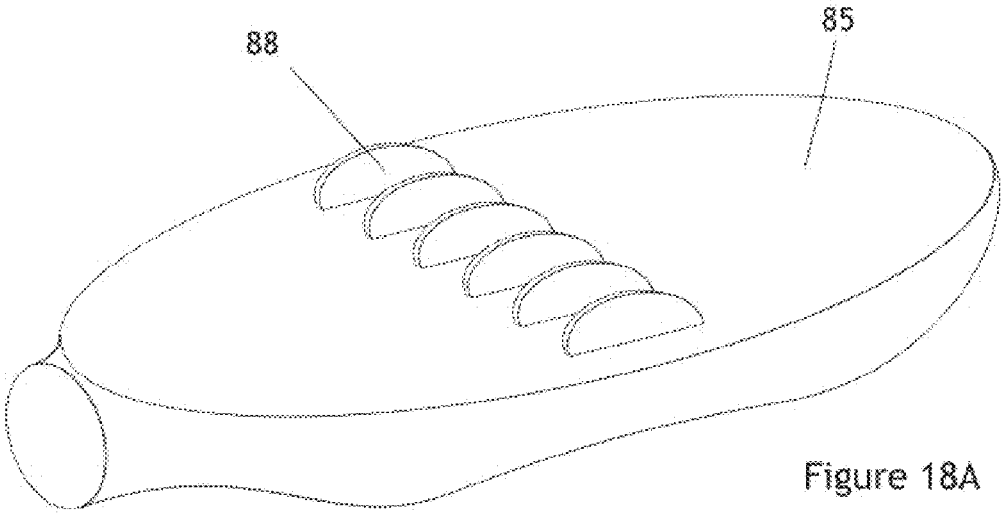
Figure 18B:
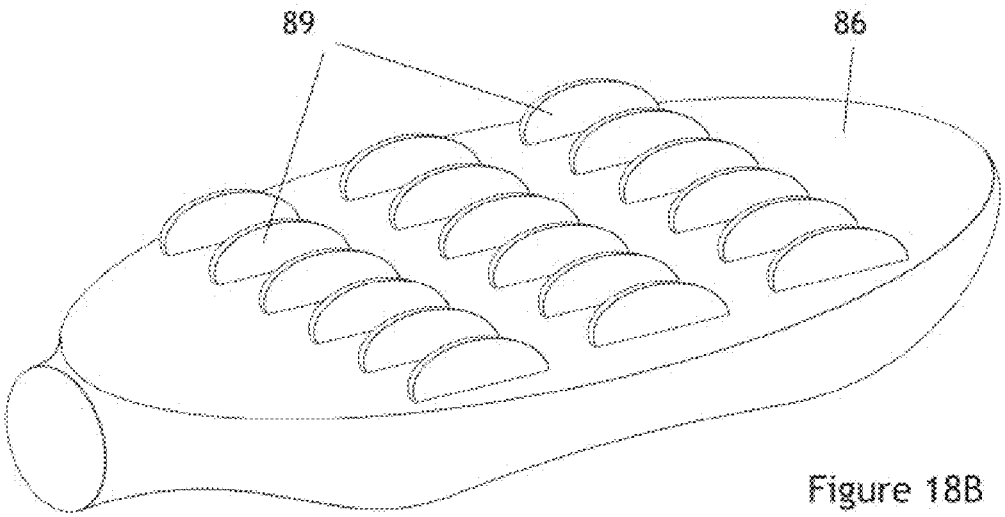
Figure 19:
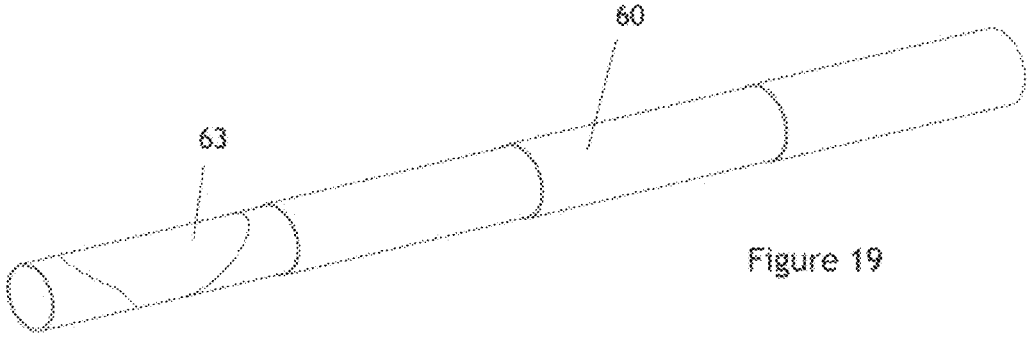
Figure 20:
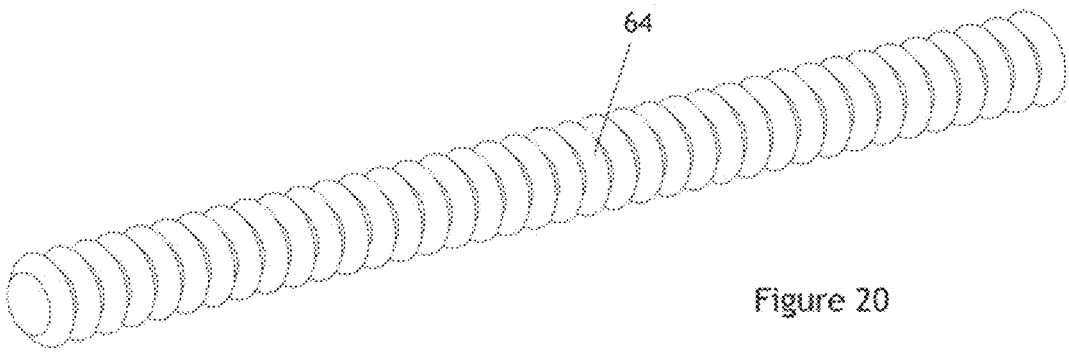
Figure 21:
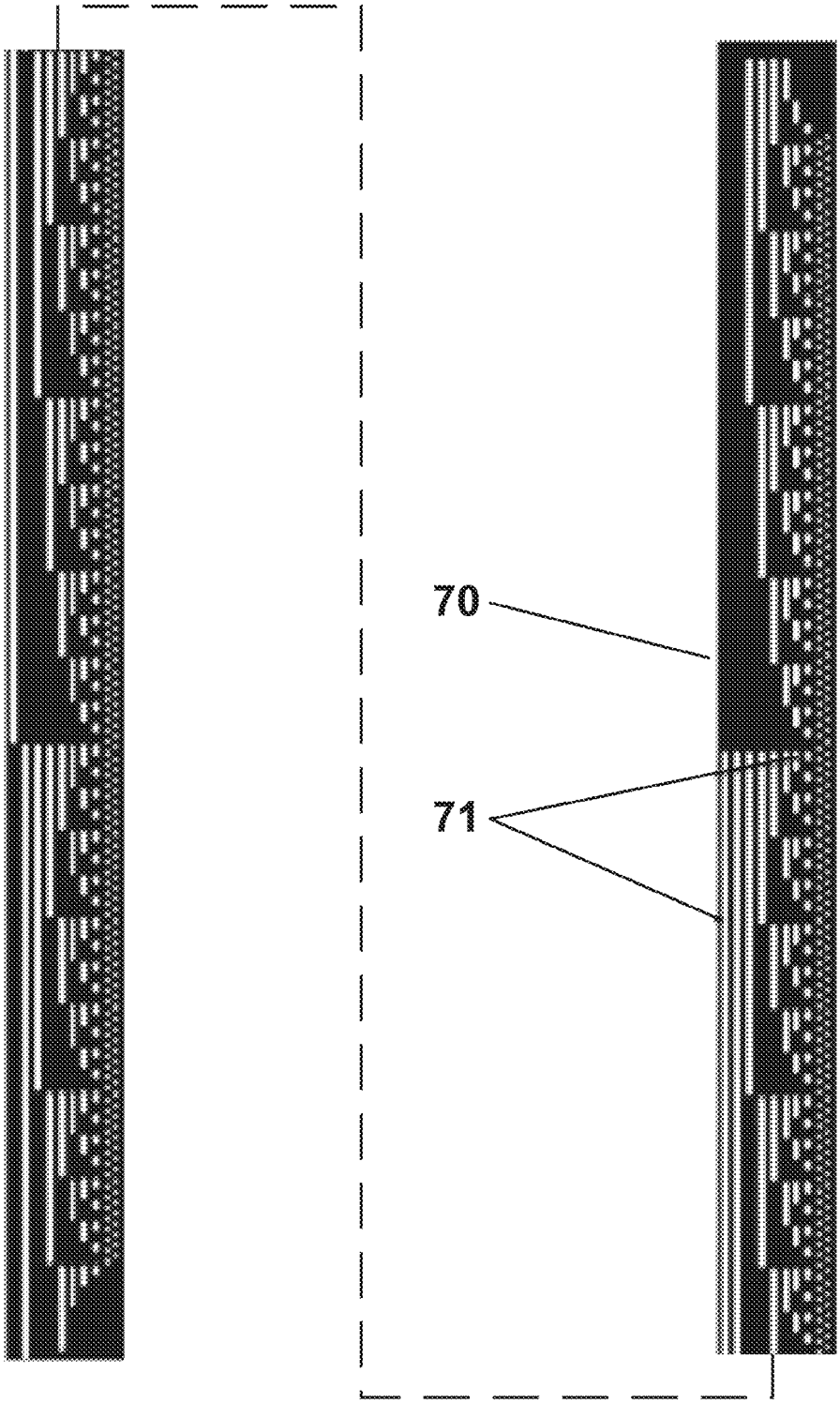
Figure 22:
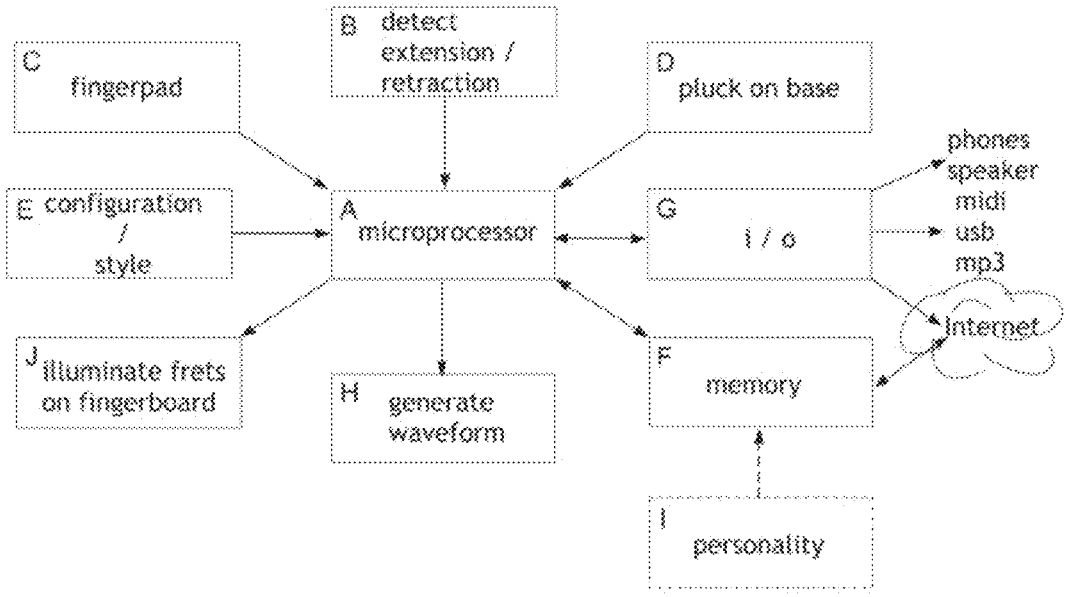
Figure 23:
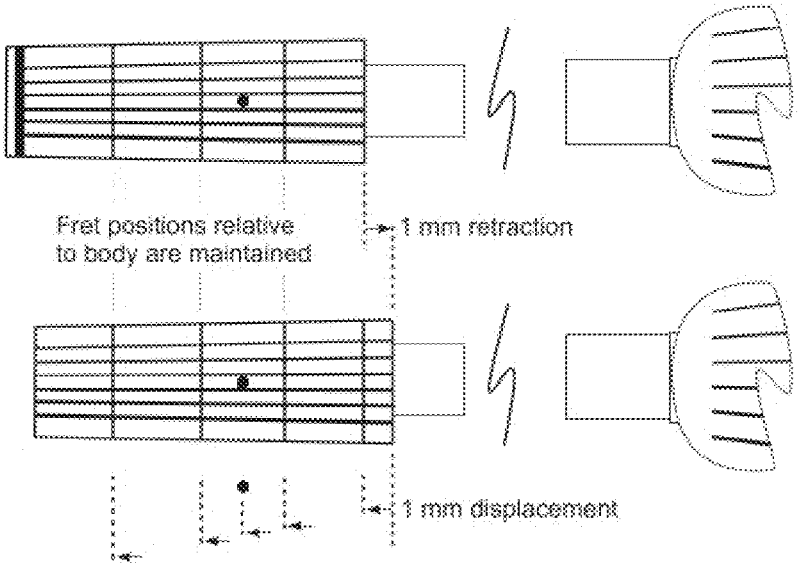
Figure 24:
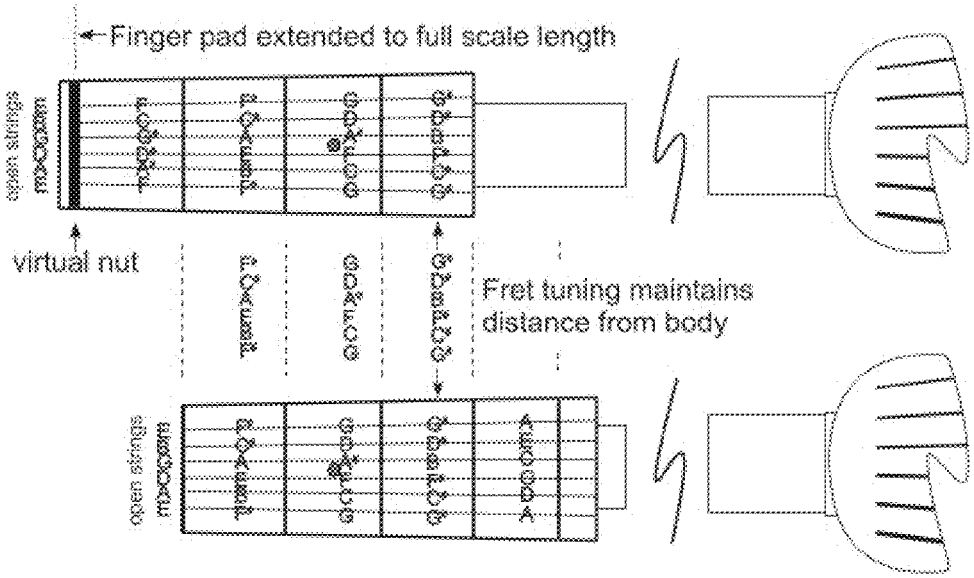

FIG. 6E in a reduced full-scale length;

FIG. 7 shows the practice guitar in a compact but still playable state;

FIGS. 8, 9A, 10A and 11A show the practice guitar at full extension, with FIGS. 9B, 10B and 11B showing enlarged views of the finger pad;

FIG. 12A shows a fingerpad assembly and FIGS. 12B, 12C and 12D its constituent parts;

FIGS. 13A and 13B show several illuminated virtual frets diagrammatically;

FIGS. 14A, 14B and 14C show a 6-string sub-assembly that may be attached to the practice guitar to give the user tactile enhancement;

FIGS. 15A, 15B and 15C illustrate a corresponding four-string sub-assembly;

FIGS. 16A and 16B show a fingerpad with an attached 6-string sub-assembly in two alternative positions;

FIGS. 17A, 17B and 17C show a 6-string sub-assembly and how it may be fitted to the body;

FIGS. 18A and 18B show alternative body constructions;

FIGS. 19 and 20 show two forms of neck for the practice guitar;

FIG. 21 shows a coded strip;

FIG. 22 is a block diagram of the electronics behind the practice guitar and how it can communicate with other equipment, and FIGS. 23 and 24 are diagrammatic illustrations of how the displacement and tuning can interact in the specific embodiment applied to a guitar.

Figure 1:
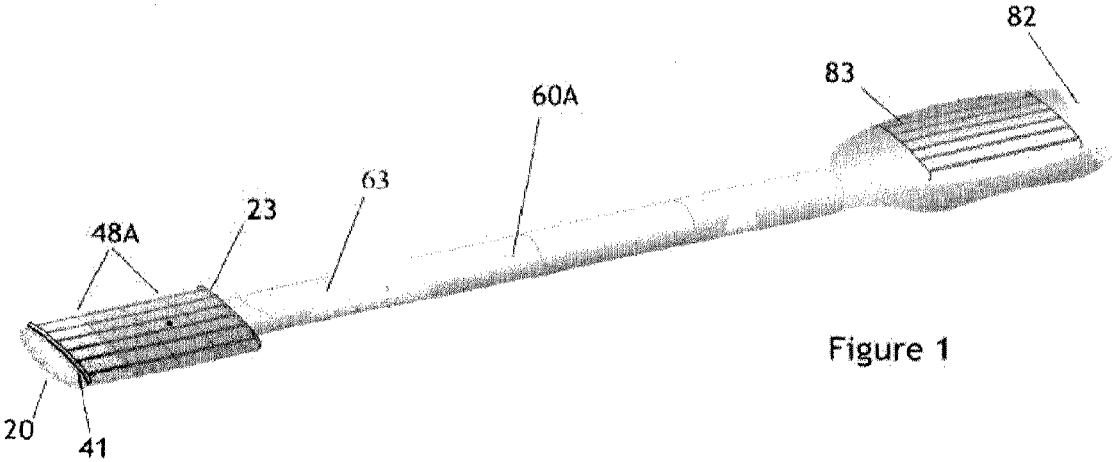
FIG. 1 shows a general perspective view of a collapsible practice guitar according to the present invention, in its fully extended state.

Referring to FIG. 1, which shows the practice guitar in its fully extended state, it consists of three main assemblies, a fingerpad 20, neck 60A and body 82, to which optional string assemblies 23 and 83 have been attached to the fingerpad, and to the body respectively.

Figure 25:
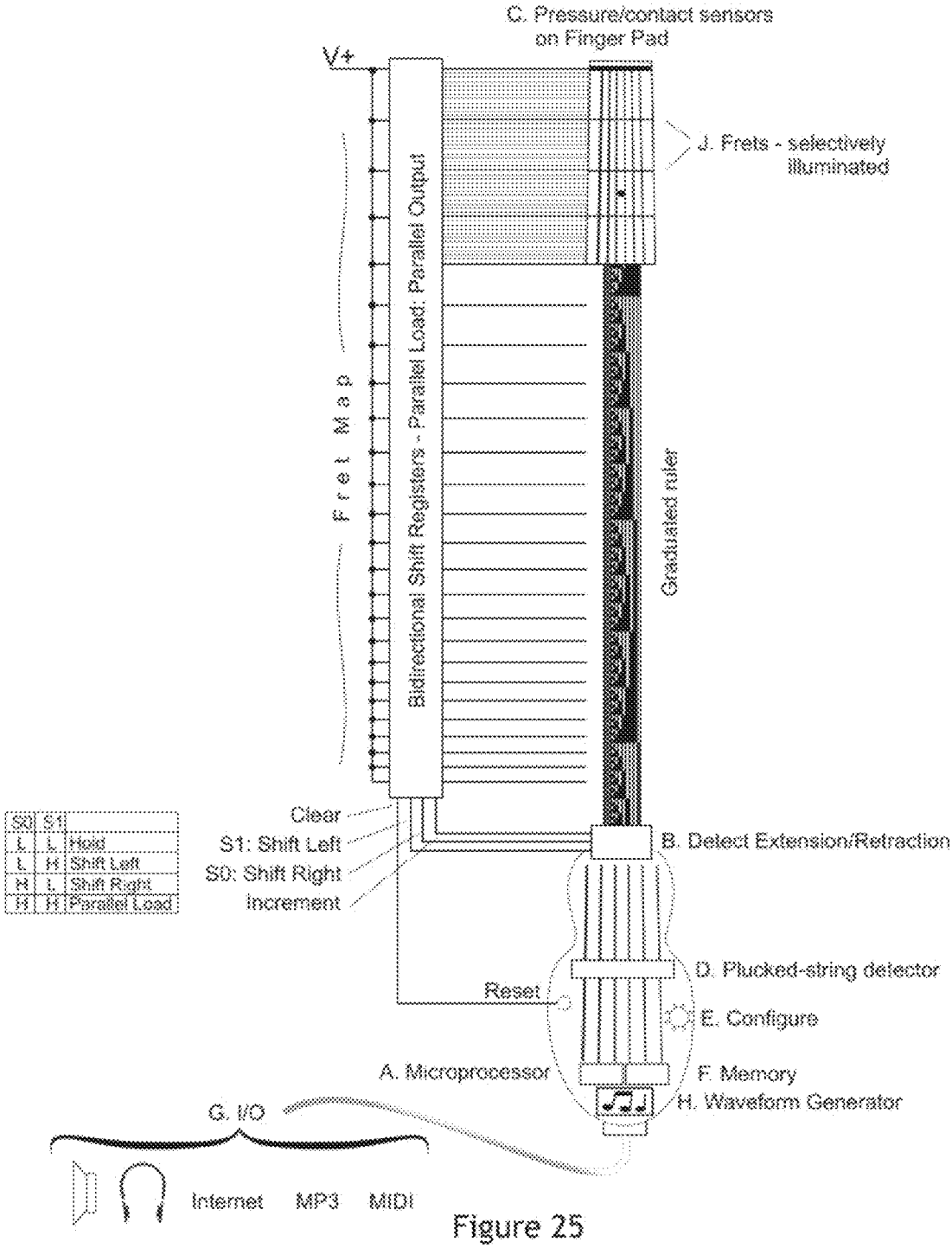

FIG. 25 is a diagrammatic illustration of how the frets can be illuminated in the specific embodiment applied to a guitar.

FIG. 1 also shows the positions of illuminated virtual frets 48A. These positions are calculated by a microprocessor in accordance with the configuration chosen by the user, and the degree of extension of the neck as explained further below. The top fret, also known as 'fret 0', is denoted 41.

To allow the instrument to be fully collapsed for transport or storage, a foldable section 63 is illustrated.

Figure 2:
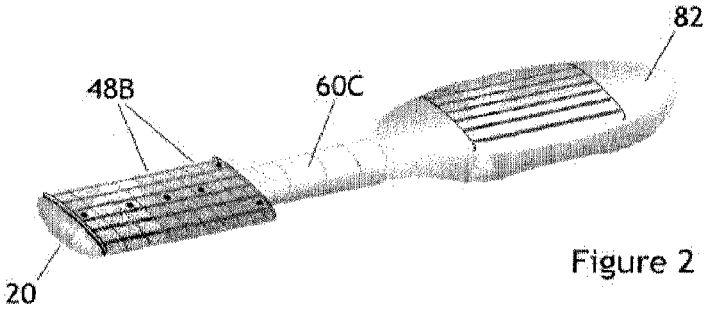
FIG. 2 shows the guitar of FIG. 1 in a partially retracted state.
Figure 3:
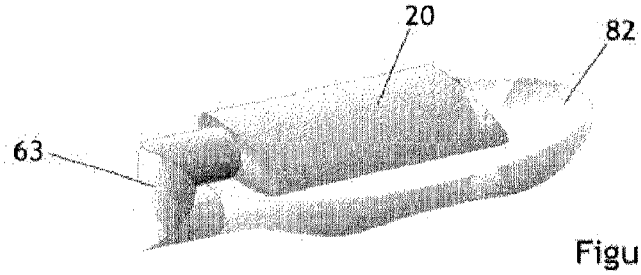
FIG. 3 shows the guitar of FIG. 1 in its fully folded state for transport or storage.

FIG. 2 shows the guitar in a partially retracted state, showing that the illuminated virtual frets denoted 48B are now more numerous and closer together. The neck denoted 60C is shorter, and can be twisted at two points to configure the guitar to the folded state for transport or storage, as shown in FIG. 3.

Figure 4A:
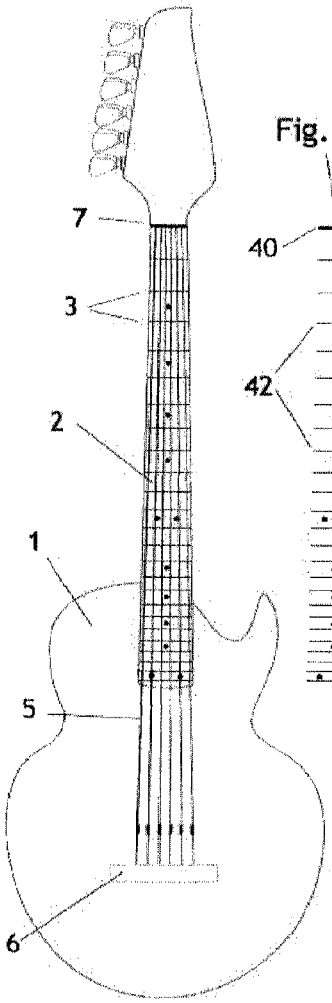
FIG. 4A shows a conventional acoustic guitar for comparison and convenience of explanation, and FIG. 4B a short length acoustic guitar.

FIG. 4A shows a standard guitar where the body is denoted 1, the finger board 2, two of the physical frets 3, the strings 5, the bridge 6 and the nut or fret 0, 7.

FIG. 5A shows spacing of the frets in isolation. It is this spacing that is emulated by the microprocessor and a section of which is 'projected' on to the surface of the fingerpad 20 as a set of 'virtual frets'.

The top fret 0 is denoted 40 and the lower frets 42.

In the complete practice guitar, the microprocessor calculates the whole range of frets, as shown in FIG. 5A, but the fingerpad 20 only displays a short section at any one time, as shown in FIG. 5B. For example, when fully extended, the fingerpad 20 may show the frets denoted 45A, when partially retracted, those denoted 45B, and when fully retracted (but still playable) denoted 45C. This is easier seen in FIGS. 6A to 6C. As shown in FIG. 6A, where the guitar is in its fully extended state, illuminated frets 48A on the fingerpad 20 match those shown in FIG. 5B as 45A. An illuminated fret marker 49 is also displayed on fingerpad 20 in the same position as on the corresponding acoustic guitar.

The top virtual fret 0 is denoted 41. FIGS. 6A, 6B and 6C also show optional string sub-assembly 23 attached to fingerpad 20.

In FIG. 6A, the neck is fully extended and denoted 60A, the body 82 and an optional string sub-assembly attached to the body 82 is denoted 83.

FIG. 6B shows the guitar in a partially extended/retracted state. The fret spacing 48B now corresponds to the fret spacing of the centre section of the acoustic guitar's finger board denoted 45B in FIG. 5B, and with the fret spacing denoted 48B closer compared with the fret spacing 48A when fully extended. The partially retracted neck is denoted 60B.

FIG. 6C shows the guitar in its fully retracted state. The fret spacing 48C now corresponds to the fret spacing of the section of the equivalent finger board of the acoustic guitar denoted 45C in FIG. 5B. The fret spacing denoted 48C is even closer than for the partially extended/retracted neck. The fully retracted neck is denoted 60C.

FIG. 6D shows the guitar in its fully folded state, ready for transport or storage, and is a view drawn from the same viewpoint as FIGS. 6A to 6C, and of the same folded state as shown in perspective in FIG. 3.

Figure 5C:
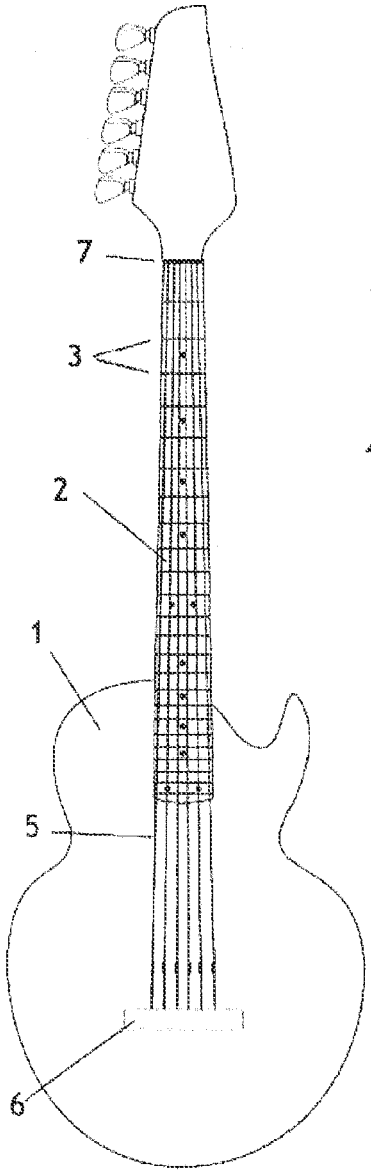
Figure 5C:
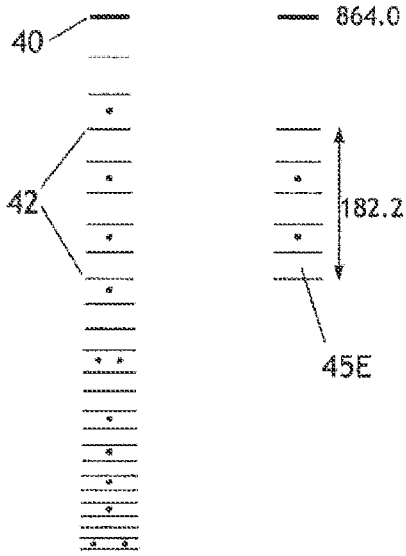

FIG. 5C illustrates the criterion for deciding the active length of the keyboard. This decision is essentially arbitrary but, in the guitar shown in the Figures, has been chosen to accommodate a realistically playable five frets for a guitar with a scale length of 864 mm.

Figure 5D:
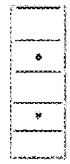

While the active length of the fingerpad 20, which results from this decision, has been chosen to be 182.2 mm, the overall length will be longer because the fingerpad 20 also has means to allow the user speedily to change the configuration. The active section of the final fingerpad is shown in FIG. 5D.

FIG. 4B shows another acoustic guitar, but of length shorter than that shown in FIG. 4A and FIG. 5E shows the corresponding fret spacing for this acoustic guitar, which is of shorter scale length. The fret spacing is closer than that shown in FIG. 5A while the number of frets remains the same.

FIG. 5F shows the frets 45D that will now be projected on to the fingerpad 20.

FIG. 6E shows a practice guitar according to the invention of reduced full-scale length which will be more suitable for, say, children. The illuminated virtual frets are denoted 48D.

Because the virtual fret spacing is determined by the microprocessor, an algorithm is programmed into the microprocessor or attached storage to change the characteristics of a practice guitar according to the invention from one corresponding to the guitar shown in FIG. 4A to one corresponding to the guitar in FIG. 4B; the scale length can be changed according to the user's wishes, e.g. to match a known guitar size or to match a non-standard intermediate, very large or very small size.

FIG. 5G shows an additional capability; while maintaining the same scale length, the scale itself may be shifted by an amount denoted 50. In this example, the top fret 40 has been relocated relative to the body to the position of the 12th fret which means that there has been an octave transposition while maintaining the same scale length. In this configuration, the user may practice their fingering of the frets furthest from the body, with the fret spacing and tonal characteristics unchanged, but with the guitar much reduced in length.

FIG. 5H shows frets 45A that will be projected on to the fingerpad 20, and it can be seen that these have the same spacing as 45A shown in FIG. 5B, but, as shown in FIG. 7, with the guitar in a more compact but still playable state, the same fret spacing 48A as that in FIG. 6A is maintained.

As a consequence of this, fret transposition can be seen with reference to FIG. 5I where the top fret, fret 0, is shown as 40. While the top fret has been relocated, in this example to the 12th fret, there is no physical restraint to prevent the user extending the instrument to its maximum physical length. Consequently, the notes further down the register 47 will be synthesised and become accessible.

FIG. 8 shows the practice guitar at full extension with the lower notes 48E projected on to fingerpad 20. By simple reprogramming, the fret display can be changed on fingerpad 20 while retaining fingerpad 20 at its maximum distance from the body.

FIG. 9A shows the guitar at full extension and FIG. 9B shows an enlarged view of the fingerpad 20 where the top fret is shown as 41 and the next frets as illuminated bars 48A. FIG. 10A shows the guitar still at full extension but with a virtual capodestre 43 'fitted'; an enlarged view is shown in FIG. 10B.

FIGS. 11A and 11B show the drop tuning of the bottom virtual string as is often used for the playing of folk music. Each note on each virtual string can be dropped or raised according to the player's wishes.

FIGS. 12A to 12D show the assembly of fingerpad 20. The foundation of the fingerpad 20 is denoted 22, one which is located first at bar-illuminating membrane 26, and over that a contact-sensitive membrane 25. Membrane 26 is configured to show several illuminated bars 48A and one of the fret markers 49 that are traditionally found on an acoustic keyboard.

While FIGS. 12B and 12C illustrate separate membranes, a single membrane may be used to provide both the contact-sensitive and bar- and fret marker-illuminating functionality.

The display of several illuminated virtual frets alters as the fingerpad 20 varies in its distance from the body as shown in FIG. 13A where the illuminated virtual frets 48A are spaced relatively far apart, and in FIG. 13B where the illuminated virtual frets 48C are spaced somewhat closer together, corresponding to the fingerpad and body being closer.

FIG. 14A shows an optional 6-string sub-assembly 23 that may be attached to the fingerpad as shown in FIG. 14B to give the user tactile enhancement. The optimum finger positions may be defined by the illuminated bars and fret markers 49, depending on the degree of separation of fingerpad and body. With the string sub-assembly attached to the fingerpad assembly, as shown in FIG. 14C, the points of location of the user's fingers are determined from the contact of the string against the contact-sensitive membrane instead of contact by the user's fingertips.

If the strings are made from a nickel-titanium alloy of the 'Muscle Wire' category, for example 'Flexinol'®, the change in tension of the strings of a standard stringed instrument over their length can be emulated by the passing of a small current through the strings.

FIGS. 15A, 15B and 15C correspond to FIGS. 14A, B and C but show the attachment of a four-string sub-assembly 24, for example for use if the practice guitar is a bass guitar. Other stringed sub-assemblies may be provided with numbers of strings other than 4 or 6.

FIGS. 16A and 16B show the appearance of the fingerpad with an attached 6-string sub-assembly when the fingerpad 20 is remote from and close to the body respectively, showing the differing fret patterns displayed.

FIG. 17A shows a 6-string sub-assembly 83 that may be fitted to the body 82 in FIG. 17B. The complete assembly is denoted 80 in FIG. 17C. The detection of plucking of one of the strings (which may feel authentic to the player's hand but which makes little or no noise, may be achieved by any convenient means.

FIG. 18A shows an alternative body 85 into which piezoelectric transducers 88 have been fitted. When flexed by the finger of a player, they emit a signal which can be sent to the microprocessor.

FIG. 18B shows a body 86 in which three rows of sensors 89 have been fitted, the outputs of which are again fed to a microprocessor.

FIG. 19 shows the telescopic neck 60 and its section 63 that is cut into three to enable it to fold into a U-shape enabling fingerpad 20 to be folded down on to the body 82 for storage or transport.

FIG. 20 shows an alternative neck 64 that is of accordion design.

FIG. 21 shows one means by which the degree of extension or retraction of the fingerpad 20 in relation to the body 82 can be achieved. It consists of a flexible strip of metal, plastic or other durable material, has holes through it or marks upon it in an arrangement such that an optical or other detector is able to identify any absolute or relative point along the strip. One end is mounted in the fingerpad (or body) and the other in a sprung roll-up spool in the body (or fingerpad), which is adjacent to the detector. Once the detector has sent a signal to the microprocessor, the microprocessor can calculate the absolute amount of extension of the neck and adjust the display on the fingerpad 20 accordingly.

Alternatively, capacitive, resistive, inductive, magnetic or other means may be employed to detect the absolute amount of extension or retraction of the neck.

FIG. 22 illustrates the basic functionality of a practice guitar constructed in accordance with the present invention. The practice guitar is controlled by means of a microprocessor denoted box A.

The microprocessor receives input from sensors on the fingerpad, box C, corresponding to the location of the user's fingers; from the sensors, box B, that measure the degree of extension or retraction of fingerpad in relation to the body; from the sensors on the body, box D; and from any additional sensors that the user uses to configure the instrument, box E.

The microprocessor processes these inputs and, as output, emits a signal determining which bars on the fingerpad are illuminated, box J. When it detects a sensor input from the body, it generates the appropriate output waveform, box H, that may be fed into speakers and/or headphones, or to a suitable storage device box F and/or other forms of output, including MIDI, MP3, OSC etc. via an input/output module denoted box G.

In addition to providing an output via box G, the practice guitar may also be configured and programmed to accept data input through this module. In this way, the user may collaborate with one or more other users locally or remotely across the Internet.

The following summary description shows the way the present invention may be embodied in a practice guitar. To elicit notes from a guitar, the fingers of the playing hand, typically the left, press a string against a fret or the fingerboard. In so doing, the length of that string between the fret or point of contact and the bridge will be of such a length that the required note will be heard when the string is plucked or stroked. To elicit different notes, the fingers of the playing hand are moved towards or away from the bridge to effectively lengthen or shorten the string.

During the playing of a stringed instrument the physical dimensions of the instrument remain the same, that is, the distance between the nut and the bridge remains constant; this distance represents the scale length (in the absence, for example, of a capo).

The current invention departs from the idea of a fixed-length instrument by use of a short section of the fingerboard, referred to as the finger pad.

The player maintains contact with this finger pad which itself is moved towards or away from the bridge to elicit notes.

The notes that are sounded rely on a microprocessor within the instrument and an algorithm that is applied in accordance with the chosen configuration of the instrument.

Throughout this description, the following terminology is used:

Fingerboard: the area of a stringed instrument, typically marked by a series of frets, upon which strings are pressed to elicit the required notes Finger pad: on the current invention, a short section derived from a fingerboard upon which finger contact or pressure is applied (in the presence of absence of 'strings'). The finger pad is physically moved towards or away from the body of the invention to elicit notes Nut: on a stringed instrument, the assembly on the fingerboard that defines one end of the strings' effective length Bridge: on a stringed instrument, the assembly on the body that defines the other end of the strings' effective length Virtual Nut: on the current invention, the region that the microprocessor calculates to represent a real nut Virtual Bridge: on the current invention, the region that the microprocessor calculates to represent a real bridge.

The physical distance between the nut and bridge of a real guitar, and the calculated distance between the virtual nut and virtual bridge on the current invention, represent the scale length.

For a stringed instrument, e.g. a guitar, the fingerboard is of fixed length and the fingers of the playing hand are moved along its length and positioned appropriately for the required notes.

For the current invention, by contrast, the playing hand maintains contact with the finger pad which itself is moved towards or away from the body of the instrument; consequently, the neck of the current invention can be extended or retracted accordingly.

The finger pad has two functions:

To detect the multiple and concurrent points of contact, as applied by the playing hand To indicate the location of the virtual frets that are projected onto the finger pad following calculation by the microprocessor The current invention is highly versatile as a result of the notes being synthesised by a microprocessor.

For the prototype, each contact- or pressure-sensitive band that is transverse across the finger pad is broken into six sub-sections that align with each of the six 'strings'. A production model will allow this to be sub-divided further to emulate any other number of 'strings', for example, to emulate a twelve-string guitar.

The light-emitting virtual frets are sub-divided into six sections; each virtual fret will typically be illuminated as a contiguous band across the full width of the finger pad but there remains the option to illuminate specific sub-sections according to the configuration of the invention.

The neck of the prototype is fabricated in several telescopic sections but any other means to facilitate extension or retraction is feasible.

Within the neck is housed the means to assess any extension or retraction.

In the prototype, a steel measuring tape has one end affixed to the finger pad while the other end in the body is wrapped around a take-up spool.

Adjacent to the take-up spool is an optical assembly that detects movement of the measuring tape and which feeds its output to the microprocessor.

The body is fitted with the means to detect which 'strings' are being plucked or stroked by the player.

There are several means to detect the plucking or stroking of the strings, for example, a string-vibration sensor akin to the pick-ups on a standard electric guitar.

For any configured scale length, the virtual frets will maintain their positions in space relative to the body.

For the purpose of illustration, let the resolution of the instrument be regarded, arbitrarily, as equal to 1 millimeter.

The term 'resolution' applies to the following two characteristics:

The distance between the centres of each transverse contact- or pressure-sensitive sensor on the finger pad The distance between the centres of each transverse light-emitting bar that indicates the virtual frets.

Regard the finger pad as being at some distance from the body and assume that a fretted configuration has been chosen. The microprocessor will 'project' and illuminate several virtual frets at specific points across the finger pad. Now assume that the player moves the finger pad towards the body by a distance of 1 mm. The measuring tape within the neck will be taken up by the take-up spool and the consequent movement of 1 mm past the optical sensor will be communicated to the microprocessor.

As a consequence, the microprocessor will extinguish all previously illuminated virtual frets and, instead, illuminate each virtual fret that is 1 mm further along the finger pad towards the virtual nut. So, while the finger pad has moved 1 mm towards the body, the virtual frets have moved away from the body by the same 1 mm and, as a consequence, each virtual fret has maintained its same displacement from the body. This is illustrated in FIG. 23.

In summary, for any distance that the finger pad moves towards the body, the micro-processor calculates which virtual frets to illuminate by the same distance away from the body. Conversely, as the finger pad is moved away from the body, the micro-processor calculates the corresponding displacement of the virtual frets towards the body.

Effectively, without changing the configuration of the instrument, the virtual frets are 'frozen in space' which means that, if placed alongside an equivalent stringed instrument, the positions of the frets remain fixed in relation to the bridge.

In addition to the task of calculating the positions of the virtual frets, the micro-processor has to calculate which notes are contained within any adjacent virtual frets. For example, if the instrument is at full extension, and is configured as for a standard six-string guitar with the open notes below the nut of: E A D G B E, the application of the player's contact or pressure between the virtual nut and the first virtual fret will result in the sounding of the notes: F $A^{\#}$ $D^{\#}$ $G^{\#}$ C F.

Now, if the finger pad is moved towards the body by a distance equal to that between the virtual nut and the first fret, the player's fingers will now effectively be above the notes: $F^{\#}$ B E A $C^{\#}$ $F^{\#}$, see FIG. 24.

Note that in a standard configuration, for any degree of extension or retraction, the open strings will sound as E A D G B E.

FIG. 25 illustrates how the frets can be illuminated under the control of discrete integrated circuits.

With the finger pad at the chosen extension, the 'Reset' button is pressed which will activate the 'Clear' function of the Bidirectional Shift Registers.

The S0 and S1 inputs to the Shift Registers are then momentarily both held High (V+) which will load the Registers in parallel in accordance with the appropriate 'Fret Map' that determines the fret spacing. The 'loaded' Registers, which at the time of Reset are outside the span of the finger pad, will store their active state until the finger pad has been retracted towards the body to such a degree that its fret indicators comes under their influence. In other words, as the finger pad is retracted or extended in relation to the body, the fret map is shifted up or down the length of the finger pad by the shift registers to illuminate the appropriate fret indicators.

The sensor that detects the movement of the finger pad towards or away from the body decodes the extent of the change as well as its direction and these values inform the shift registers in regard to how the Fret Map is manipulated.

Preferably, the microprocessor will be programmed to control the illumination of the frets in accordance with a selection of pre-defined or customisable Fret Maps; alternatively, the mapping will be calculated by the microprocessor under the instruction of a selection of stored or downloadable algorithms.

In summary, while the finger pad may be moved towards or away from the body, the notes, as well as the positions of the virtual frets, maintain their positions in space relative to the bridge—as is the case for a real stringed instrument. Also, the tuning of the open strings maintains authenticity with the configuration chosen by the player. For example, in FIG. 24, regardless of the degree of extension or retraction, the open strings for a 6-string standard configuration will be: E A D G B E.

For illustration, an arbitrary resolution of 1 mm was chosen; however, the relative positions of the virtual nut and the virtual bridge can be measured to a much higher accuracy by, for example, optical means or the adoption of the technology used by electronic vernier calipers.

The limitations in practice, then, relate to the resolution achievable for the light-emitting means chosen to indicate the virtual frets, and ultimately, to the utility of providing a resolution beyond any player's capabilities or usefulness.

The invention claimed is:

1. A musical instrument having a first fingerboard portion designed to be operated by one hand of a player and a second body portion designed to be operated by the other hand, means within each of the two portions for sensing, at multiple lateral locations across a respective portion, at least one of activity, position or movement of its respective hand or a finger of such hand, means in each of the two portions adapted to produce an output pitch of at least one note corresponding to the music being generated by the user, and means enabling the two portions to communicate with one another, and further in which the portions are separate interacting units, at least one of which is played using the fingers of one hand, and the instrument includes means to detect the degree of separation of the units from one another and to dynamically modify the pitch of notes of the music being generated by the instrument in response thereto; and further in which each of the fingerboard and body portions is provided with a plurality of real or virtual strings "plucked" by the user, and wherein the fingerboard portion and the body portion are connected together so that actuation of one or more of the strings on the body portion by one hand will cause a signal to be emitted corresponding to one or more musical notes, the pitch of which is determined by the position of the fingers of the other hand on the fingerboard portion.

2. A musical instrument according to claim 1 and including telescopic means physically holding the two portions together so that they are played with the hands relatively close to one another or at a distance apart, and wherein the degree of telescoping is arranged to change the way in which the input to the instrument from at least one of the player's hands is treated.

3. A musical instrument according to claim 1 wherein the sensing means are selected from proximity sensors, piezoelectric transducers, pressure sensors, and sensors operating on the basis of capacitative, inductive or resistive change.

4. A musical instrument according to claim 1 wherein the two portions are separate and each includes its own power supply to enable it to operate and to communicate with the other portion.

5. A musical instrument according to claim 1 wherein the fingerboard portion is configured to replicate a short section of a fretted fingerboard as on a plucked fretted guitar or like instrument.

6. A musical instrument according to claim 1 wherein both fingerboard and body portions have real strings to simulate the feel of a conventionally plucked stringed instrument.

7. A musical instrument according to claim 6 wherein the strings are made from an alloy enabling a change in tension of the strings to be effected by passing of a current through the strings.

8. A musical instrument according to claim 1 wherein the fingerboard portion and body portion are connected together by means of an extendible neck and including means dependent on the degree of extension to modify the pitch of the notes produced.

* * * * *